United States Patent [19]

Day, Sr.

[11] Patent Number: 4,961,584

[45] Date of Patent: Oct. 9, 1990

[54] BOARD GAME APPARATUS

[76] Inventor: Grayling B. Day, Sr., 200 Springhill Rd. N., Fernandino Beach, Fla. 32034

[21] Appl. No.: 470,255

[22] Filed: Jan. 25, 1990

[51] Int. Cl.[5] ..... A63F 3/00; A63F 7/30

[52] U.S. Cl. ..... 273/357; 273/255; 273/394; 446/473

[58] Field of Search ..... 273/356, 357, 255, 262, 273/394, 396; 446/473

[56] References Cited

U.S. PATENT DOCUMENTS

| | | | |
|---|---|---|---|
| 691,643 | 1/1902 | Loss et al. | 273/396 X |
| 2,285,292 | 6/1942 | Mangels | 273/356 X |
| 2,869,873 | 1/1959 | Tornabene | 446/473 X |
| 3,009,703 | 11/1961 | Jentsch et al. | 273/356 |
| 3,375,008 | 3/1968 | Atkinson | 273/357 |
| 4,123,059 | 10/1978 | Guibas | 273/356 |
| 4,185,824 | 1/1980 | Natwick | 273/356 |
| 4,227,695 | 10/1980 | Neal, Jr. | 273/255 |
| 4,754,980 | 7/1988 | Torgow | 273/356 |

*Primary Examiner*—William H. Grieb

*Attorney, Agent, or Firm*—Leon Gilden

[57] ABSTRACT

An apparatus is set forth including a planar board game formed with a clock-wise path thereabout. The path includes a plurality of "safe" zones positioned intermediate "action" positions. The "action" positions include directions per each symbolic position to alternatively draw a card from a central card deck and require the drawing player to draw a gun in coordination with an opposing player whose position corresponds to a coloration of card drawn. Sequentially, the individuals fire a spherical projectile into designated conduits of a target, and the first sphere to appear at a lower end portion of a chute associated with the target is the winner of that draw. The winning player is the first to successfully have fired all of a predetermined number of projectiles awarded each player at the outset of the game.

6 Claims, 4 Drawing Sheets

10
11
11a
11b
11c
11d
1
2
3
4
5
6
7
8
9
12
13
20

BOARD GAME APPARATUS

BACKGROUND OF THE INVENTION

1. Field of the Invention

The field of invention relates to board game apparatus, and more particularly pertains to a new and improved board game wherein the same simulates western style gun fighting and further enhances coordination skills in the achieving of point totals within the game.

2. Description of the Prior Art

Various trajectory apparatus is available in the prior art to selectively fire projectiles at a predetermined target. The instant invention coordinates the utilization of such prior art devices in cooperation with a board game to enhance interest and develop coordination skills in the playing of the game. Examples of the prior art include U.S. Pat. No 4,123,059 to Guibas wherein a game device utilizes variously sized conduits for receiving projectiles within an apparatus.

U.S. Pat. No. 2,285,292 to Mangels sets forth an example of a trajectory apparatus utilizing projectiles fired at targets within an enclosure defined by the apparatus.

U.S. Pat. No. 3,009,703 to Jentsch sets forth a pneumatically operative gun and target apparatus to fire projectiles within a target.

U.S. Pat. No. 4,185,824 to Natwick sets forth an arcade type amusement device for pneumatically directing spheres towards an associated target.

U.S. Pat. No. 4,754,980 to Torgow sets forth a game apparatus with a spin indicator positioned medially of opposed guns, wherein the guns are utilized to fire projectiles in association with targets of the game.

As such, it may be appreciated that there is a continuing need for a new and improved board game apparatus wherein the same addresses both the problems of providing stimulation and requiring an enhanced level of skill in the utilization of the game and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same utilizes cooperating structure of a board game cooperative with individual projectile firing pistols to provide an amusement organization stimulating skill and coordination in the playing of the game. As such, the general purpose of the present invention, which will be described subsequently in greater detail, is to provide a new and improved board game apparatus which has all the advantages of the prior art board game apparatus and none of the disadvantages.

To attain this, the present invention sets forth an apparatus including a planar board game formed with a clock-wise path thereabout. The path includes a plurality of "safe" zones positioned intermediate "action" positions. The "action" positions include directions per each symbolic position to alternatively draw a card from a central card deck and require the drawing player to draw a gun in coordination with an opposing player whose position corresponds to a coloration of card drawn. Sequentially, the individuals fire a spherical projectile into designated conduits of a target, and the first sphere to appear at a lower end portion of a chute associated with the target is the winner of that draw.

The winning player is the first to successfully have fired all of a predetermined number of projectiles awarded each player at the outset of the game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

Still another object of the present invention is to provide a new and improved board game apparatus wherein the same utilizes projectile firing pistols in cooperation with a board game to provide enhanced amusement and skill in the playing of the game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
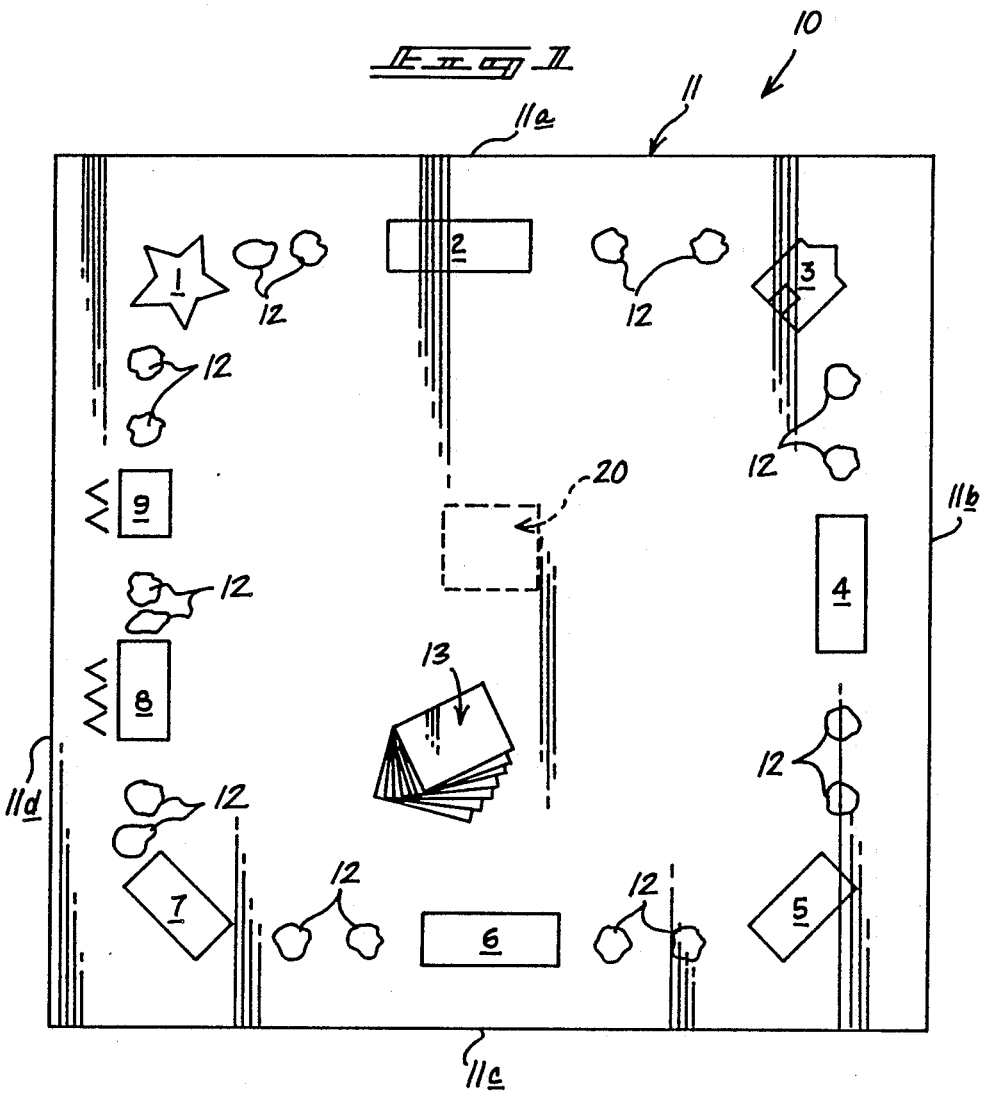
FIG. 1 is a top orthographic view of a board game of the instant invention.

With reference now to the drawings, and in particular to FIGS. 1 to 8 thereof, a new and improved board game apparatus embodying the principles and concepts of the present invention and generally designated by the reference numeral 10 will be described.

Figure 2:
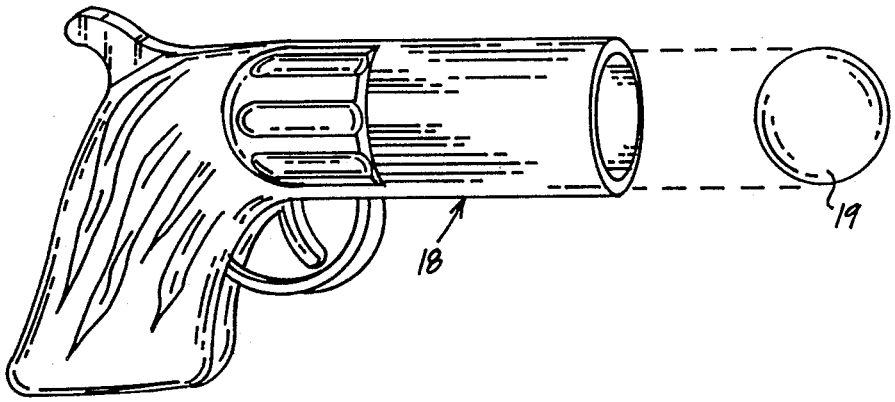
FIG. 2 is an isometric illustration of a projectile firing pistol utilized by the instant invention in association with the spherical projectile utilized.

More specifically, the board game apparatus 10 of the instant invention essentially comprises a planar game board 11 defined by top playing surface including four perimeter sides comprising a first blue side 11*a*, a second red side 11*b*, a third yellow side 11*c*, and a fourth green side 11*d*. The playing surface of the game board includes a clock-wise path adjacent the perimeter of the game board including various positions thereon. The star space 1 is utilized as a position where each player, upon landing upon this star position 1, is directed to "collect one bullet". The "bullets" utilized in the game are illustrated in FIG. 2 as a series of balls 19 defined by a predetermined diameter utilized in cooperation with a spring-loaded pistol 18 to hurtle a respective ball therefrom. Each player at the outset of the game is awarded four balls, or "bullets", to be utilized in the playing of the game, to be discussed in more detail below. Spaces 2, 4, 5, 6, 7, 8, and 9 are spaces to cooperate with the deck of cards 13. A player upon landing on one of the designated spaces 2 through 9 is directed to draw a card from the deck 13. The draw card spaces 2 through 9 are as follows:

Space 2 - Indian Country
Space 8 - Bank
Space 4 - Safety Zone Hardware Store, Collect one bullet
Space 5 - Corral
Space 6 - Jail
Space 7 - Saloon
Space 8 - First Mountain Range
Space 9 - Second Mountain Range.

Figure 5:
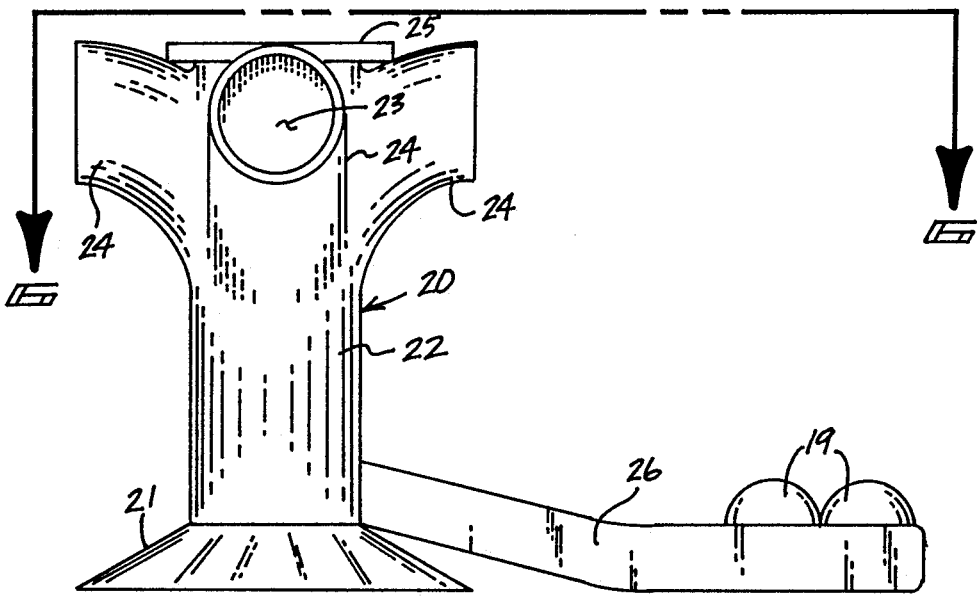
FIG. 5 is an orthographic side view taken in elevation of the target utilized by the instant invention.
Figure 6:
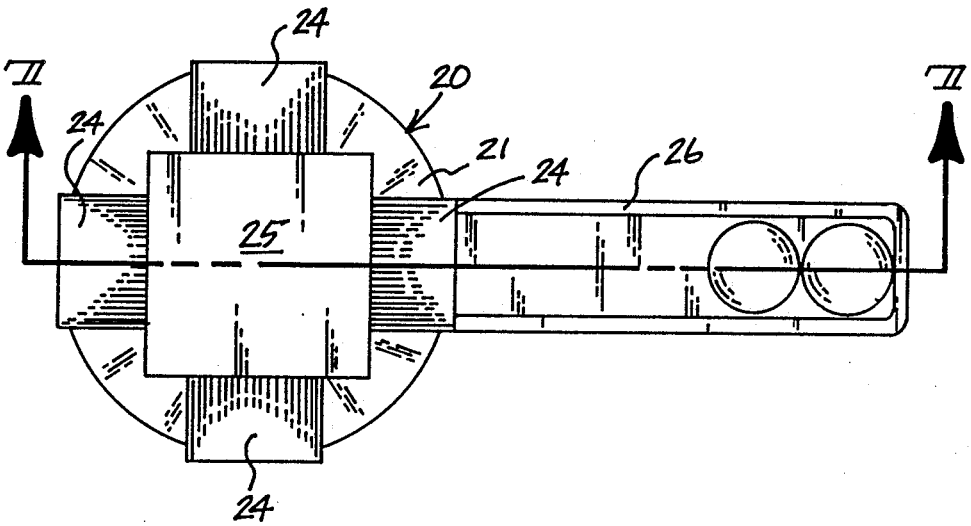
FIG. 6 is a top orthographic view taken along the lines 6—6 of FIG. 5 in the direction indicated by the arrows.
Figure 7:
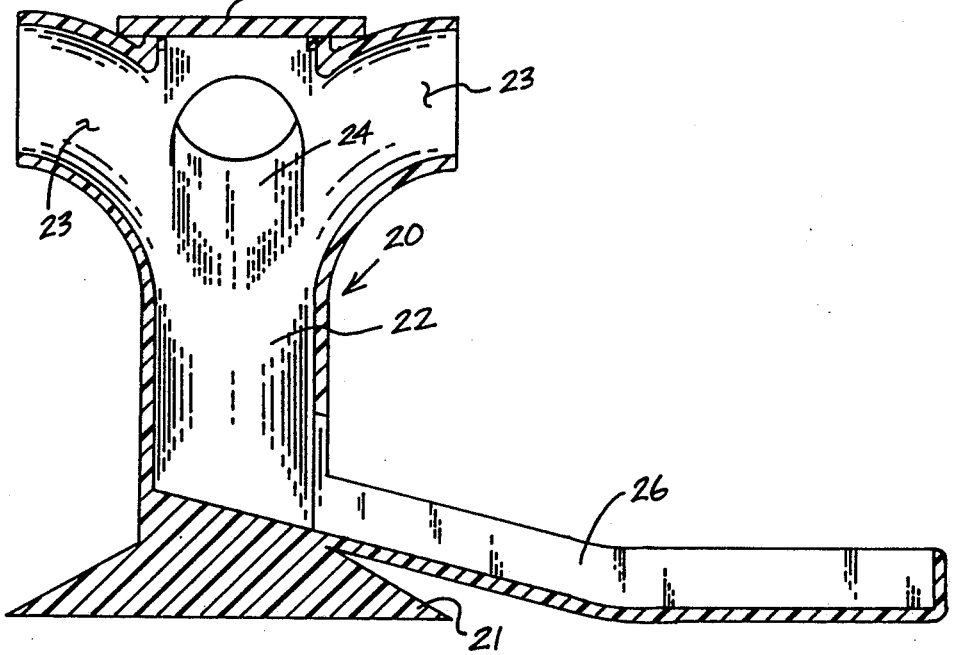
FIG. 7 is an orthographic view taken along the lines 7—7 of FIG. 6 in the direction indicated by the arrows.

The card deck 13 comprises a predetermined number of cards typically utilizing fifty cards. The fifty cards are coordinated with each of the player stations, positions blue, red, yellow, and green, cooperative with each of the player positions 11*a*, 11*b*, 11*c*, and 11*d* respectively. Between each of the spaces 1 through 9 of the playing surface are a plurality of "safe" positions 12 set forth as "stepping stones". A player upon landing upon one of the "stepping stones" is not required to draw a card from the deck 13. A player upon landing upon one of the spaces 2, 3, 5, 6, 7, 8, and 9 is required to draw a card from the deck 13. The deck of cards 13 comprises five yellow cards, five red cards, five blue cards, five green cards, five yellow and red cards, five yellow and blue cards, five yellow and green cards, five red and blue cards, five red and green cards, and five black cards. A player upon landing upon one of the draw card positions will require every player to place a hand upon the playing surface of the game board 11 prior to a card being drawn from the deck 13 A card upon being drawn from the deck 18, such as yellow for example, will require the drawing player and the "yellow" player to simultaneously draw their associated spring-loaded pistols 19 and fire a projectile 19 into the target 20 of the game. Each of the projectiles 19 are also color coded in association with each of the respective players, i.e. four blue projectiles, four red projectiles, four yellow projectiles, and four green projectiles. The target 20, as illustrated in FIGS. 5–7, will be discussed in more detail below. A black card means everyone draws his gun and fires in to the target 20.

The target 20 comprises a flared support base 21 formed with a hollow defined delivery tube 22. The delivery tube 22 is defined by a tube diameter substantially equal to or somewhat greater than that defined by the predetermined diameter of each of the balls 19. In no event should the tube diameter be equal to or greater than twice the predetermined diameter of each of the balls to enable directing of a single ball one at a time through the central tube 22. The central tube 22 is cooperative with four arcuate tubes 24 displaced ninety degrees relative to one another, wherein each of the tubes include a conduit 28 cooperating with the central tube 22. A removable cap 25 is mounted overlying the central tube 22 coaxially thereof and removable to enable manual removal of balls that may be jammed together as they are directed interiorly of each of the respective tubes 24. A chute 26 cooperates at a lowermost end with the central tube 24 and the coloration of the first ball to be received within a lowermost end of the tube, i.e. a forwardmost ball, is the winner of that particular drawing event. The winner of the game is the player to deplete that player's allowance of balls. A player upon landing upon the spaces 1 or 4, or "safety zones", is required to collect another bullet or spherical ping pong ball 19 in the playing of the game.

Figure 8:
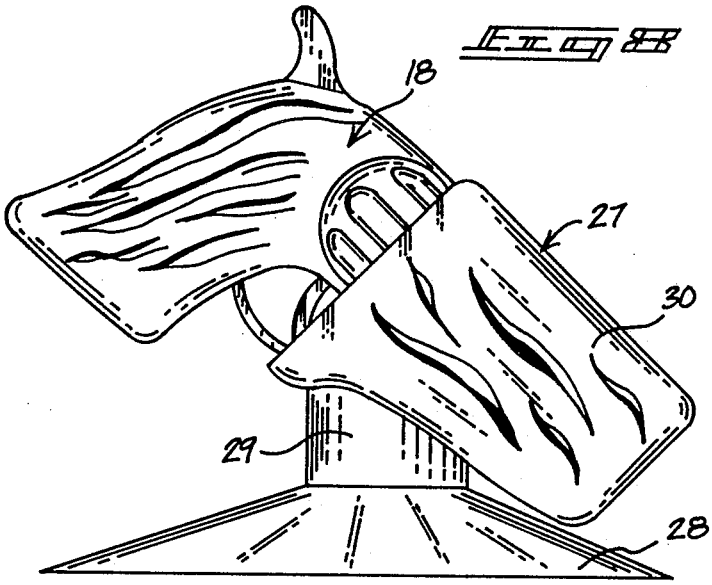
FIG. 8 is an orthographic side view taken in elevation of a holster member utilized by each player of the instant invention.

FIG. 8 is illustrative of a gun holster 27 awarded each player and positioned adjacent each player position 1*a* through 11*d*. The gun holster comprises a flared holster base 28 formed with a central holster support 29 coaxially formed relative to the base 28, with a sleeve 30 integrally mounted at an upper end of the holster support 29 at an acute angle thereto to receive an associated or respective gun 18 associated with each player.

Figure 3:
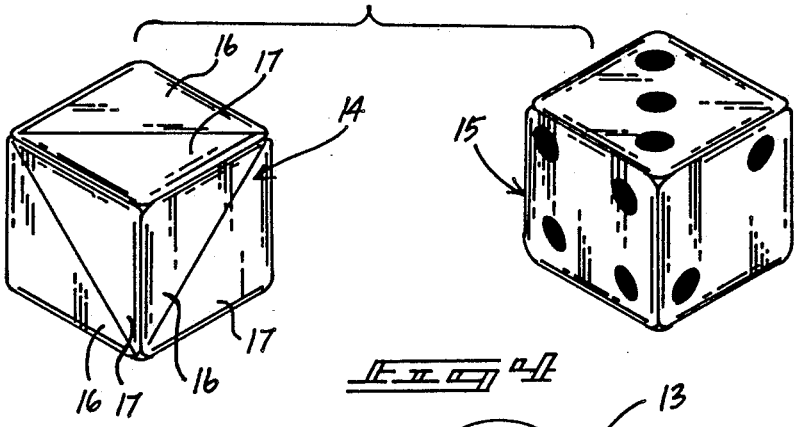
FIG. 3 is an isometric illustration of dice utilized by the instant invention.
Figure 4:
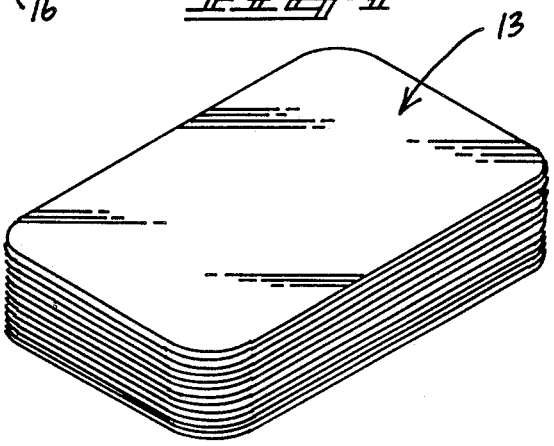
FIG. 4 is an isometric illustration of the deck of cards utilized by the instant invention.

FIG. 3 illustrates a dice member 15 with typical dice indicia to be rolled by each player sequentially to indicate the number of spaces to be traveled about the game board. Dice member 14 is utilized in alternative play of the game, wherein in lieu of drawing a card 13, a player upon landing upon a draw card space 2, 3, 5, 6, 7, 8, or 9 rolls the dice member 14. The dice member 14 includes a first color zone 16 and a second color zone 17 diagonally separated relative to one another. The color zones upon each face of the six sided dice 14 includes plural colorations of the following, "blue and red; blue and green; blue and yellow; red and green; red and yellow; yellow and green". The two colors appearing in a horizontal orientation upon a roll of the dice 14 requires the two players associated with the two aforenoted colorations to simultaneously draw and direct fire into an associated conduit 28 of the target 20.

As to the manner of usage and operation of the instant invention, the same should be apparent from the above disclosure, and accordingly no further discussion relative to the manner of usage and operation of the instant invention shall be discussed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A board game apparatus comprising a planar game board including a top playing surface, and the playing surface defining a first player side, a second player side, a third player side, and a fourth player side positioned in association with each side of the game board, and the playing surface including a path of travel, the path of travel including positions adjacent the sides of the playing surface, the positions including a first position for collecting a projectile, a second drawing position, a third drawing position, a fourth safe position, a fifth drawing position, a sixth drawing position, a seventh drawing position, an eighth drawing position, and a ninth drawing position, and a firing indicator means for directing a player to effect a drawing and firing maneuver against an opposing player indicated by the firing means, and a first, a second, a third, and a fourth pistol member associated with each player to enable each player to effect a firing maneuver, and a predetermined number of projectiles awarded each player defined by a first series of projectiles, a second series of projectiles, a third series of projectiles, and a fourth series of projectiles associated with each respective first, second, third, and fourth player, and a target means for receiving projectiles by each of the players upon each of the players effecting a firing maneuver directed by the firing means.

2. The board game apparatus as set forth in claim 1 wherein the firing indicator means including a deck of cards, the deck of cards including a first series of colors, a second series of colors, a third series of colors, and a fourth series of colors, and each of the series of colors associated with each of the first, second, third, and fourth players respectively.

3. A board game apparatus as set forth in claim 2 wherein the path of travel further includes a plurality of further safe positions formed on the playing surface between each of the drawing positions.

4. A board game apparatus as set forth in claim 3 wherein the predetermined number of projectiles is four, and each player is awarded the predetermined number of projectiles of a respective first coloration, second coloration, third coloration, and fourth coloration associated with each respective first, second, third, and fourth player.

5. A board game apparatus as set forth in claim 4 wherein the target member includes a flared support base and a central hollow tube directed coaxially and upwardly of a support base, and the central tube defining a central conduit, and a chute member cooperative with the central conduit, and a first, second, third, and fourth hollow tube in cooperation with the central tube, the hollow tubes arranged cooperating with the central conduit and are displaced ninety degrees relative to one another, and a removable cap mounted coaxially and overlying the central conduit and the hollow tubes, and the hollow tubes and the central conduit defined by a predetermined diameter substantially equal to a projectile diameter defined by each of the projectiles.

6. A game board apparatus as set forth in claim 5 wherein each player is provided a holster member, each holster member includes a flared central holster support including a central holster support member coaxially and upwardly mounted relative to the holster support, and a sleeve integrally mounted at an acute angle relative to the holster support slidably receiving each respective pistol therewithin.

* * * * *